US009828217B2

(12) United States Patent
Lohr

(10) Patent No.: US 9,828,217 B2
(45) Date of Patent: Nov. 28, 2017

(54) FRAME FOR A CAR OF A PASSENGER/FREIGHT ELEVATOR, AND SUCH A CAR AND PASSENGER/FREIGHT ELEVATOR

(71) Applicant: LOHR LIFTEN B.V., Zevenaar (NL)

(72) Inventor: Uwe Lohr, Kralendijk (BQ)

(73) Assignee: Lohr Liften B.V. (NL)

( * ) Notice: Subject to any disclaimer, the term of this patent is extended or adjusted under 35 U.S.C. 154(b) by 711 days.

(21) Appl. No.: 14/365,462

(22) PCT Filed: Dec. 12, 2012

(86) PCT No.: PCT/NL2012/050881

§ 371 (c)(1),
(2) Date: Jun. 13, 2014

(87) PCT Pub. No.: WO2013/095113

PCT Pub. Date: Jun. 27, 2013

(65) Prior Publication Data

US 2014/0374197 A1 Dec. 25, 2014

(30) Foreign Application Priority Data

Dec. 13, 2011 (NL) ..... 2007961

(51) Int. Cl.
*B66B 11/02* (2006.01)

(52) U.S. Cl.
CPC ..... *B66B 11/0206* (2013.01); *B66B 11/0226* (2013.01)

(58) Field of Classification Search
CPC ..... B66B 11/0206; B66B 11/0226
See application file for complete search history.

(56) References Cited

U.S. PATENT DOCUMENTS 5,975,249 A * 11/1999 Tomaseti ..... B66B 11/0226 187/401
6,209,686 B1 * 4/2001 Tomasetti ..... B66B 11/0226 187/401
8,528,702 B2 * 9/2013 Maury ..... B66B 11/0206 187/266

FOREIGN PATENT DOCUMENTS

JP 5132269 A 5/1993
WO 2009013387 A1 1/2009

OTHER PUBLICATIONS

International Search Report and Written Opinion I dated Aug. 7, 2013 (PCT/NL2012/050881); ISA/EP.
International Search Report and Written Opinion II dated Aug. 7, 2013 (PCT/NL2012/050881); ISA/EP.

* cited by examiner

*Primary Examiner* — William A Rivera
*Assistant Examiner* — Stefan Kruer
(74) *Attorney, Agent, or Firm* — Banner & Witcoff, Ltd.

(57) ABSTRACT

The present invention relates to a frame (20) for a car (10) of a passenger/freight elevator. The invention further relates to a car provided with such a frame. Finally, the invention also relates to an elevator comprising such a car. According to the invention the frame (20) comprises an upright (21, 22) having connected thereto a support (23, 24) which comprises two parts placed at an angle relative to each other, which parts are integrally connected. One part (23A, 24A) is connected here to the upright and the other part (23B, 24B) to a bottom part (33) of the car (10).

7 Claims, 7 Drawing Sheets

FRAME FOR A CAR OF A PASSENGER/FREIGHT ELEVATOR, AND SUCH A CAR AND PASSENGER/FREIGHT ELEVATOR

The present application is a U.S. National Phase filing of International Application No. PCT/NL2012/050881, filed on Dec. 12, 2012, designating the United States of America and claiming priority to Netherlands Patent Application No. 2007961, filed Dec. 13, 2011. The present application claims priority to and the benefit of all the above-identified applications, and all the above-identified applications are incorporated by reference herein in their entireties.

The present invention relates to a frame for a car of a passenger/freight elevator. The invention further relates to a car provided with such a frame. Finally, the invention also relates to an elevator comprising such a car.

Passenger/freight elevators are characterized in that they have a relatively high load capacity per surface area. It is hereby necessary that the elevator car, and particularly the frame thereof, be sufficiently strong to be able to bear the forces occurring during use. The known passenger/freight elevator comprises for this purpose on the underside of the elevator car a reinforcement in the form of transverse beams. Because these transverse beams protrude considerably in downward direction, an elevator pit has to be arranged during construction of the elevator installation. Such a pit makes it possible for the elevator car to be positioned in the lowest position such that the floor of the elevator car lies in line with a storey floor.

A drawback of the known elevator car is that it is not possible to arrange an elevator pit in every building or structure. A further drawback is that, when new buildings are being designed, the elevator pit is seen as undesirable design requirement at least partly determining, among others, the floor construction of a lowest storey for the elevator.

An object of the present invention is to provide a frame or elevator car, wherein the above stated drawbacks do not occur, or hardly so.

According to a first aspect of the present invention, this object is achieved with a frame for a car of a passenger/freight elevator comprising a pair of uprights disposed parallel to each other and extending in a transport direction of the passenger/freight elevator. Each upright is coupled here to a support. Each support has a first part and a second part integrally connected thereto. These parts lie at an angle relative to each other. The first part further runs parallel to the upright and is coupled to the upright in a direction transversely of the transport direction. The second parts of the supports extend in a plane for the purpose of supporting a bottom part of the passenger/freight elevator.

The angle between the first part and the second part of the support is preferably such that, after assembly of an empty car, the second part bends relative to the first part so that the then resulting angle amounts to 90 degrees.

According to the present invention a downward force on the bottom part of the passenger/freight elevator is absorbed by the supports and the uprights. Owing to the particular form of the supports, the load is transmitted via the second parts to the first parts integrally connected thereto. These are connected to the upright via a transverse connection. Use is preferably made here of a connection at multiple points, such as a welded connection or the use of a plurality of bolts. Because the first part extends in the transport direction, parallel to the upright, it is possible to realize the connecting points over a great distance between the upright and the support. The frame according to the invention can hereby cope with a greater load than a frame in which the bottom part is connected to the upright in a direction parallel to the bottom part.

In an embodiment the uprights each take a substantially at least partially hollow form. The first part of each support can further be at least partially received here in the associated upright. Because the upright takes an at least partially, and preferably wholly hollow form, the total weight of the upright can remain limited without this detracting from the strength. This however also makes it possible to receive the first part of the support in the upright, whereby a compact solution can be achieved.

In a further embodiment each support comprises a transition part between, and integrally connected to, the first and second parts. Each upright can further be provided at an end directed toward the bottom part with a recess through which the transition part of the associated support protrudes. An advantageous construction can thus be achieved, wherein the whole first part of the support is received in the hollow upright and wherein the whole second part is located outside the upright. The transition part is preferably a curved element forming the transition between the substantially elongate first and second parts. The recess can be formed here in that one side of the hollow upright does not extend as far as the other sides. If the upright for instance take the form of a tubular element of U-shaped cross-section, a wall of the upright directed toward the bottom part can extend less far downward than the other walls. The space hereby created can be used by the transition part. The height of the transition part at the position of this wall is preferably such here that the underside of the transition part lies substantially in line with an underside of the other walls of the upright.

In a further embodiment the recess and the transition part are formed such that an underside of each upright lies in line with an underside of the second part of the associated support. The underside of the frame, or the car comprising this frame, is hereby substantially flat and does not protrude on the underside, or hardly so, whereby the space required under the car is limited to a minimum.

In an embodiment each support comprises a plurality of substantially identical strips, wherein the plurality of strips are placed adjacently of each other in a direction transversely of the transport direction for the purpose of forming the support. In this embodiment the support is not therefore manufactured as one integral part but is realized on site by mutually adjacent placing of substantially identical strips.

The use of strips provides a number of advantages. A first advantage is that the carrying capacity of the car can be increased in relatively simple manner by using more strips. Another advantage is that it is relatively easy to construct the elevator car on site. This is because the individual strips are easier to handle and assemble than a support consisting of one piece. In addition, the use of strips is more attractive in terms of cost because a wide variety of cars of different loading capacities can be realized using a series of substantially identical components.

In a further embodiment the strips are connected to each other and to the upright by a non-releasable connection such as a welded connection. In a recommended embodiment the strips are however connected to each other and to the upright by a releasable connection. An example of such a releasable connection is an embodiment wherein apart of each of the strips which corresponds to the first part of the support and the associated upright comprise corresponding openings through which a coupling means, such as a bolt, is placed for the purpose of coupling the strips to each other and to the upright. The bolt can be secured here in per se known manner, such as with a nut.

In an embodiment the frame is provided at an end remote from the bottom part with a first transverse connection between the pair of uprights and/or the frame is provided at an end directed toward the bottom part with a second transverse connection between the pair of uprights. The above stated transverse connections strengthen the construction of the car in the transverse direction and also provide for and/or support the parallel disposition of the uprights.

In an embodiment each upright is coupled to a further support, wherein each further support comprises a third part and a fourth part integrally connected thereto, which parts lie at an angle relative to each other, wherein the third part runs parallel to the upright and is coupled to the upright in a direction transversely of the transport direction, and wherein the fourth parts of the further supports extend in a plane for the purpose of supporting a ceiling part of the passenger/freight elevator. In this embodiment supports are thus also used on the upper side in addition to the supports on the underside of the frame or the car. The advantages of the further supports are similar to those of the supports on the underside. These supports can however absorb forces which are exerted on the ceiling part. These forces may be direct, for instance in that the ceiling part itself has to bear a weight, or indirect, in that a load is transmitted from the car to the ceiling part.

The angle between the third part and the fourth part of the further support is preferably such that, following assembly of an empty car, the fourth part bends relative to the third part so that the then resulting angle amounts to 90 degrees.

In a further embodiment, wherein the uprights take an at least partially hollow form, each further support comprises a further transition part between, and integrally connected to, the third and fourth part, and each upright is provided at an end directed toward the ceiling part with a further recess through which the further transition part of the associated further support protrudes. The further recess and the further transition part are formed here such that an upper side of each upright lies in line with an upper side of the third part of the support. In this embodiment a substantially symmetrical construction is obtained in respect of uprights, supports and further supports. It is advantageous here for the further support and/or upright to be embodied as the above stated support and/or upright. The use of a plurality of strips is once again an advantageous embodiment here for the further support.

The further support and the support can be mutually coupled for the purpose of distributing the load exerted on the bottom part. This is for instance possible by making use of a tensioning connection per upright between the second part of the associated support and the fourth part of the associated further support. An example of such a tensioning connection is a pull rod.

According to a second aspect, the present invention provides a car of a passenger/freight elevator comprising the above described frame.

In an embodiment the car further comprises a bottom part provided with an opening in which the second part of a support is at least partially received. It is recommended here to provide an opening for each support. These openings can for instance be formed as a channel connecting to the second part of the support. This channel preferably extends over the whole bottom part and over substantially the whole length of the second part of the support.

In order to connect the second part to the bottom part it is advantageous for the second part of a support and the bottom part to comprise corresponding coupling openings through which a coupling means, such as a bolt, is placed for the purpose of coupling the support to the bottom part. In another embodiment the bottom part is however provided with clamping elements for clamping the second part of a support in the bottom part. These clamping elements can for instance be embodied as bolts.

In an embodiment of the car the support is formed by a plurality of strips as described above. In this embodiment however, a part of each of the strips which corresponds to the second part of the support and the bottom part comprise corresponding openings through which a coupling means, such as a bolt, is placed for the purpose of coupling the strips to each other and to the bottom part.

In an embodiment the car comprises further supports as described above, as well as a ceiling part. The ceiling part is provided here with an opening in which the fourth part of the further support is at least partially received. This opening is preferably formed as a channel connecting to the fourth part of the further support.

In a further embodiment the fourth part of the further support and the ceiling part comprise corresponding coupling openings through which a coupling means, such as a bolt, is placed for the purpose of coupling the further support to the ceiling part. In another embodiment the ceiling part is however provided with clamping elements for clamping the fourth part of a further support in the ceiling part. These clamping elements can for instance be embodied as bolts.

According to a third aspect, the invention provides a passenger/freight elevator comprising the above described car.

The invention will be discussed in more detail hereinbelow, wherein.

Figure 1B:
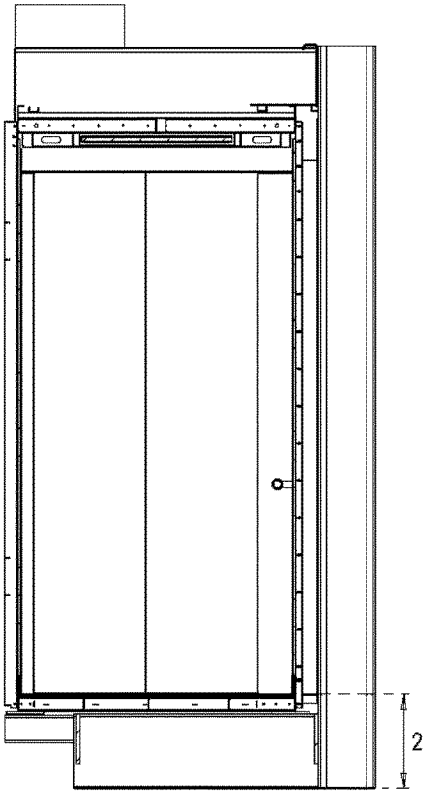
FIGS. 1A and 1B show respectively a schematic view and a side view of a known elevator car.
Figure 1A:
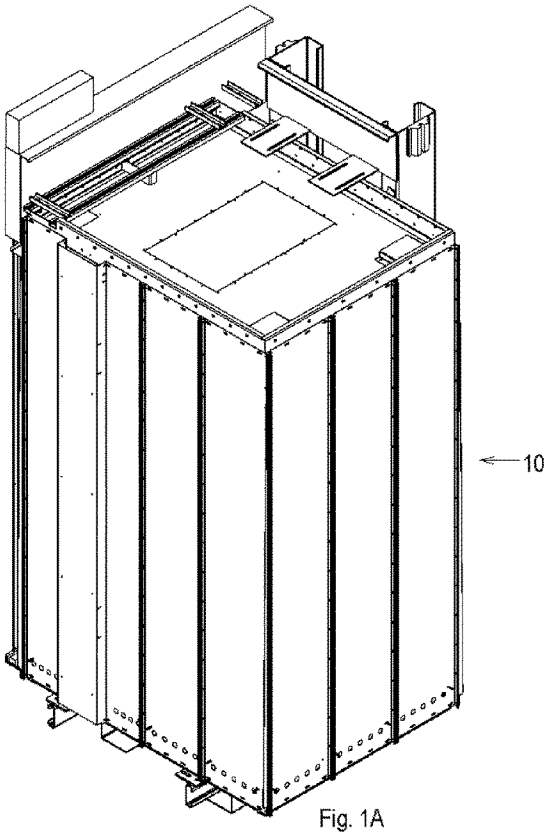

FIGS. 1A and 1B show respectively a schematic view and a side view of a known elevator car 1. It will be apparent here that arranged on the underside is a reinforcement with height 2 for the purpose of strengthening the car such that it can bear a determined load. Because this height 2 is considerable, it has to be taken into account during placing of the elevator or during construction of the building in which the elevator is placed. Provided for this purpose on the underside of the elevator shaft in which the elevator is mounted is an elevator pit. It is however not always possible or desirable to make such a pit.

Figure 2:
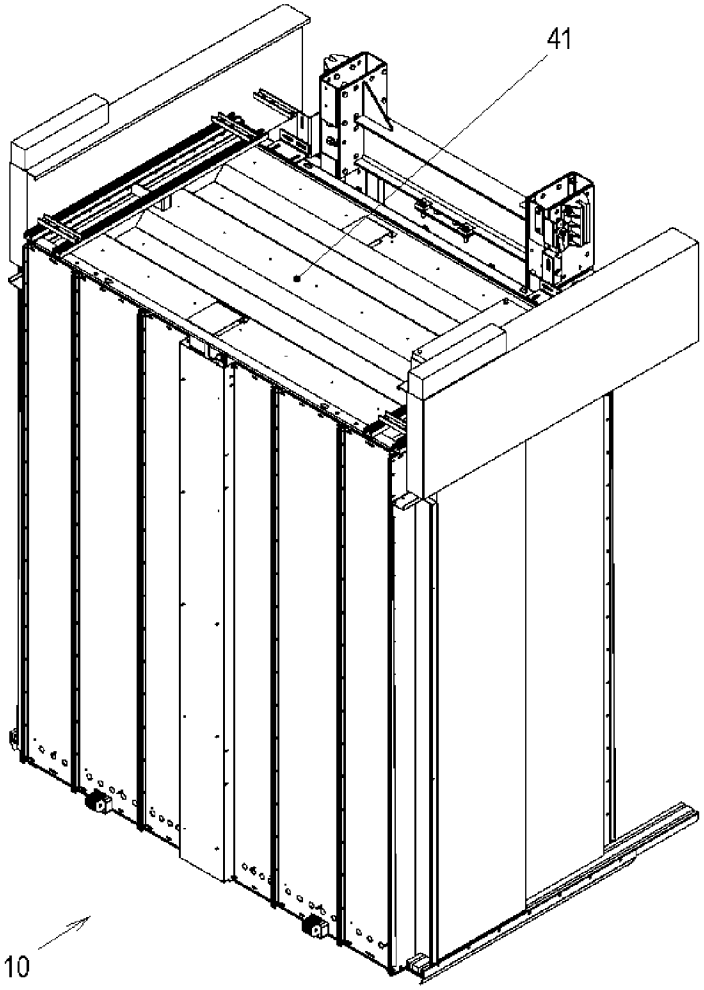
FIG. 2 shows an embodiment of an elevator car according to the present invention.
Figure 3B:
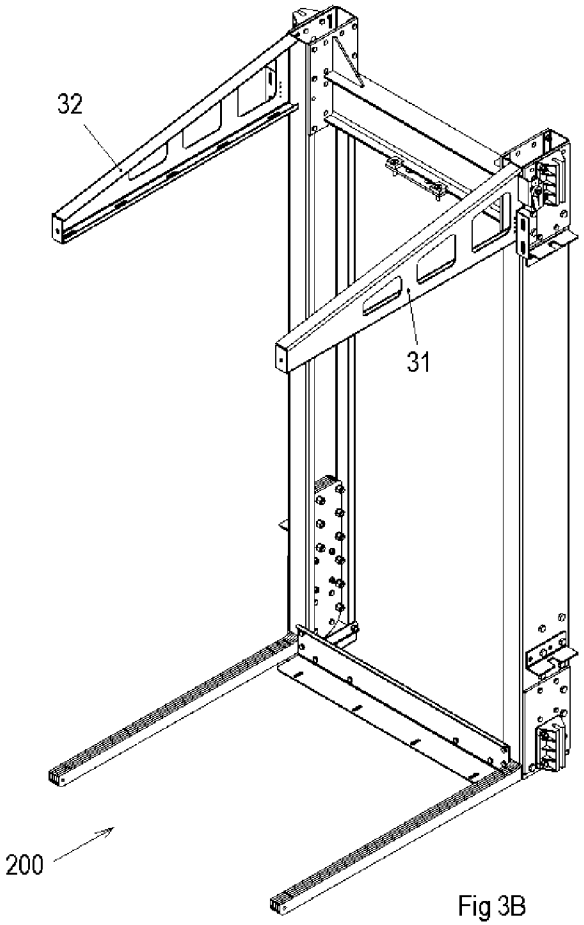
FIGS. 3A and 3B show two embodiments of a frame for an elevator car according to the present invention.

FIG. 2 shows an embodiment of an elevator car 10 according to the present invention. It will be immediately apparent from this figure that the underside of car 10 does not protrude as far downward as car 1 of FIG. 1A. This is possible because of the specific frame construction according to the invention, embodiments of which are shown in FIGS. 3A and 3B.

Figure 3A:
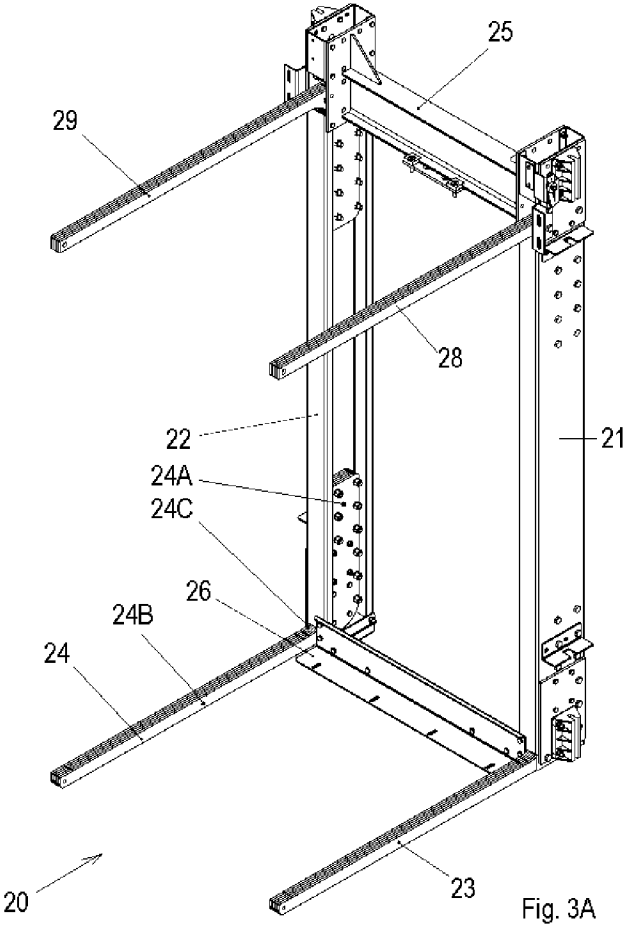
Figure 4:
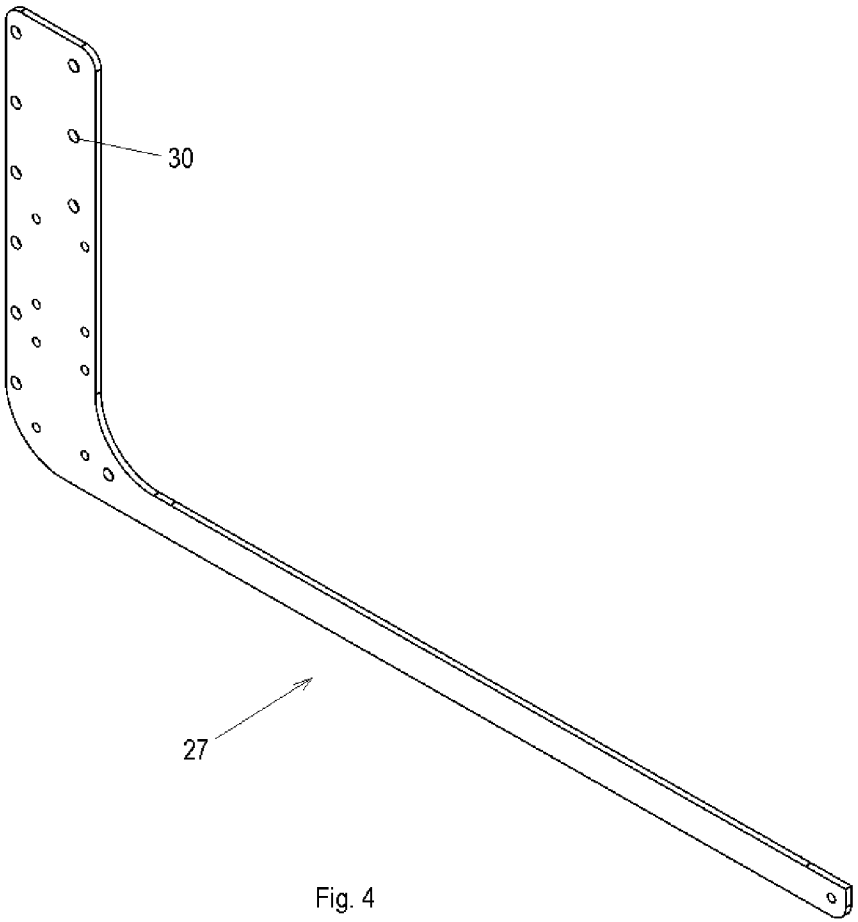
FIG. 4 shows an embodiment of a strip for the purpose of forming a support of FIG. 3A.

FIG. 3A shows a frame 20 comprising a pair of uprights 21, 22 and a pair of supports 23, 24 which are attached to uprights 21, 22. Uprights 21, 22 are mutually connected here by transverse connections 25, 26. It is noted here that supports 23, 24 are embodied as a series of strips which are disposed adjacently of each other. A detail view of such a strip 27 is shown in FIG. 4.

Also visible in FIG. 3A are further supports 28, 29. These supports 28, 29 are similar to supports 23, 24 in respect of construction and are thus also embodied as a series of strips.

Each support 23, 24 comprises a first part, such as part 24A for support 24, a second part, such as part 24B for support 24, and a transition part, such as part 24C for support 24. Transition part 24C here forms a transition between parts 24A and 24B. The different parts of supports 23, 24 are integrally connected to each other and are preferably manufactured integrally from a type of steel with sufficient hardness. An example of such a steel is known under material number 1.8974.

The angle between the first part and the second part of support 23, 24 and the angle between the third part and the fourth part of further support 28, 29 are preferably such that, following assembly of an empty car, the bottom part lies perpendicularly of uprights 21, 22.

Each of the strips 27 comprises a plurality of openings 30, see FIG. 3A. Inserted through these openings are bolts with which supports 23, 24 are connected to uprights 21, 22. Because an elevator car is usually constructed at the location where the car will actually be used, the plurality of strips provides advantages compared to a single integral component. This is because the weight of such a component would complicate the assembly considerably. The use of strips further provides the option of adjusting the carrying capacity of the car to the conditions. The carrying capacity of the car can after all be increased by placing more strips.

The connection between strips 27 and the associated upright 21, 22 thus takes place using a plurality of bolts. Because the first part of supports 23, 24 extends over a considerable length along the associated upright 21, 22, it is possible to work with a relatively large contact surface between support 23, 24 and upright 21, 22. This increases the strength of the connection between support 23, 24 and upright 21, 22.

Further supports 28, 29 can be coupled to supports 23, 24 by means of tensioning elements such as a tensioning cable, pull rod or tensioning beam (not shown). This achieves that a load exerted on the bottom of car 20 is distributed over supports 23, 24 and further supports 28, 29.

The use of such supports is however not essential, as shown in FIG. 3B. Shown here is another embodiment of a frame 200 in which other further supports 31, 32 which do not consist of a plurality of strips are used on the upper side. Whether further supports 28, 29 have to be used depends on the expected loading of the elevator car.

It will be apparent from FIGS. 3A and 3B that uprights 21, 22 take a hollow form in order to limit the weight of uprights 21, 22. Uprights 21, 22 can be embodied here as partially open tubular structures, for instance with a U-shaped cross-section, as shown in FIGS. 3A and 3B.

Figure 6:
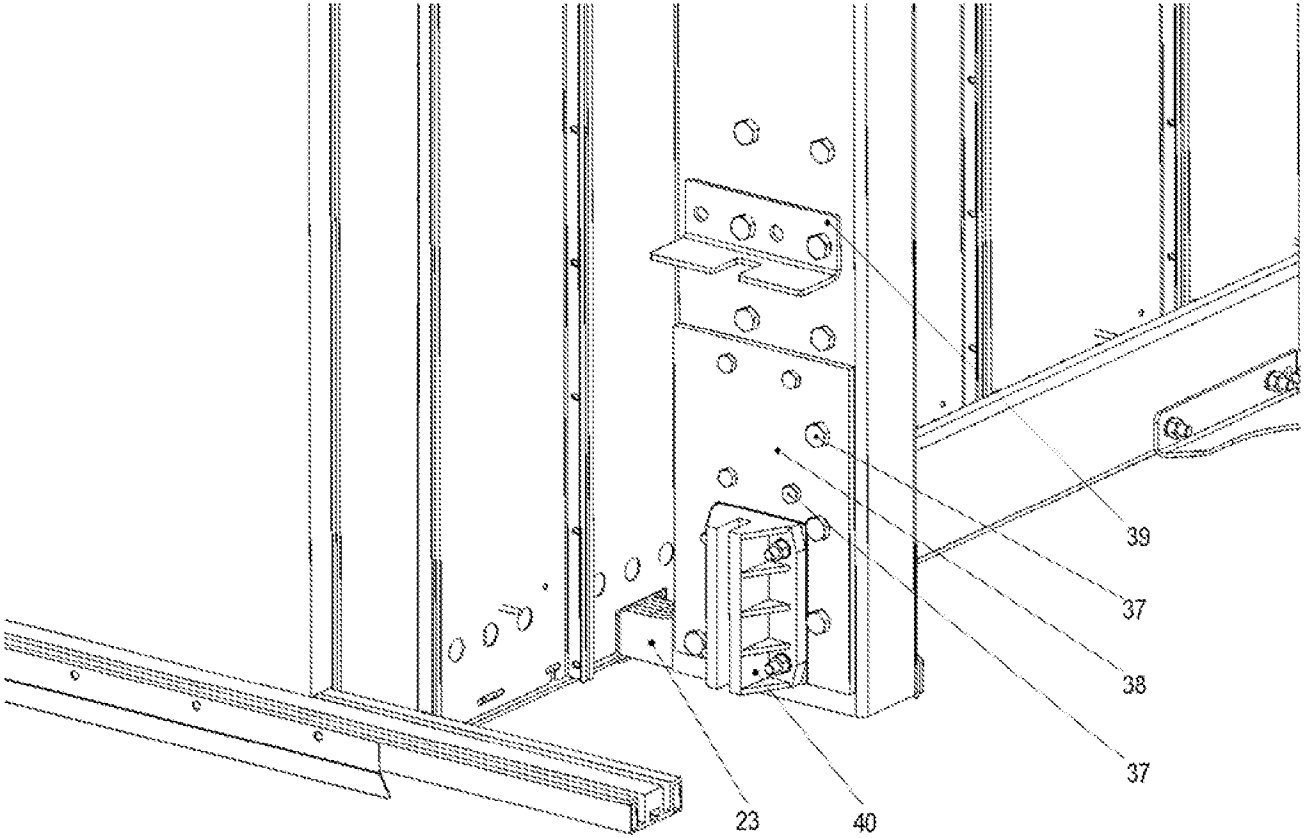
FIG. 6 shows a side view of the coupling between support, upright and bottom part as according to the embodiment of FIG. 3A.

In FIGS. 3A and 3B each of the uprights 21, 22 comprises three walls. The wall directed toward bottom part 33 does not run as far downward here as the other walls. The hereby created recess is utilized by the transition part of the associated support 23, 24. As shown in FIG. 6, the height of the transition part and the recess can be chosen here such that a substantially flat underside of the car can be realized.

Per se known elements of an elevator car, such as wall elements and automatic sliding doors, can be mounted on frame 20, 200.

Figure 5A:
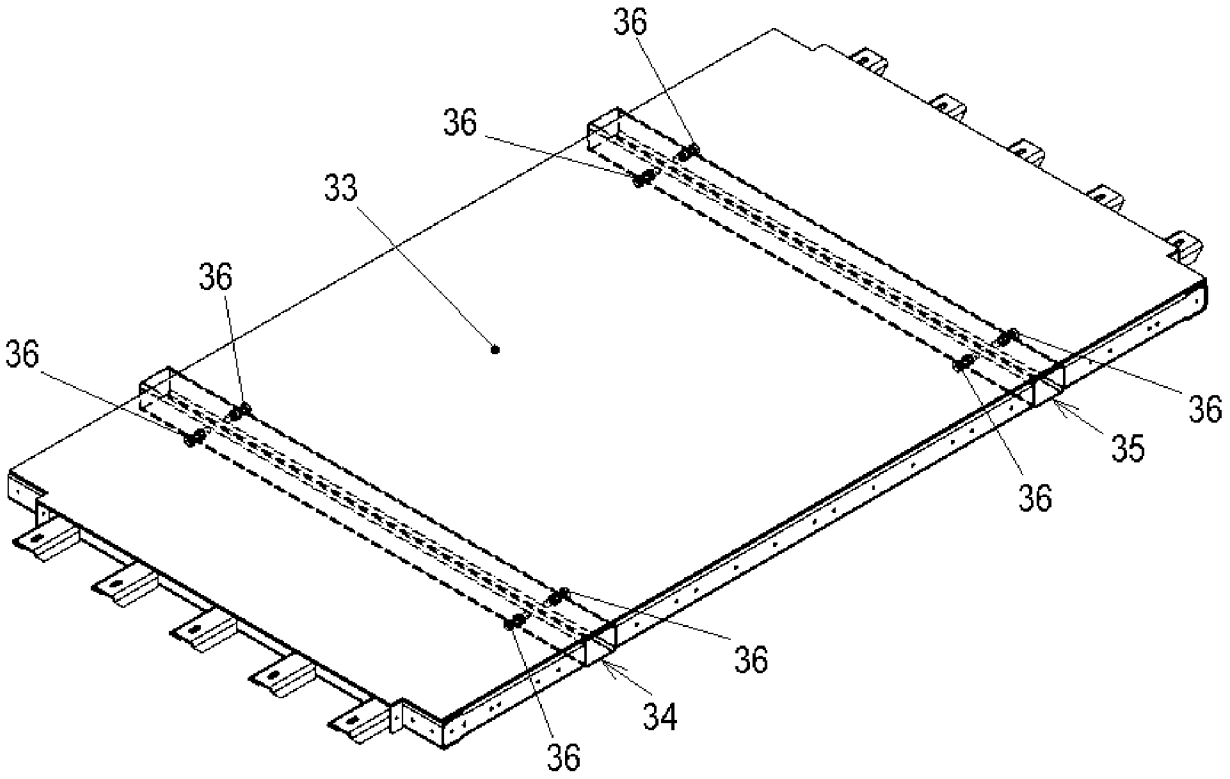
FIG. 5A shows the bottom part of the car of FIG. 2

FIG. 5A shows a bottom part 33 which can be coupled to frame 20 or frame 200. Bottom part 33 comprises for this purpose two openings in the form of channels 34, 35. Received in bottom part 33 are a number of bolts 36 which can be used to clamp supports 23, 24 in bottom part 33. It is relatively easy to adjust bottom part 33 using this construction. In another embodiment strips 27 likewise comprise openings at the position of bottom part 33. Bolts with which supports 23, 24 are attached to bottom part 33 can be placed through these openings.

Figure 5B:
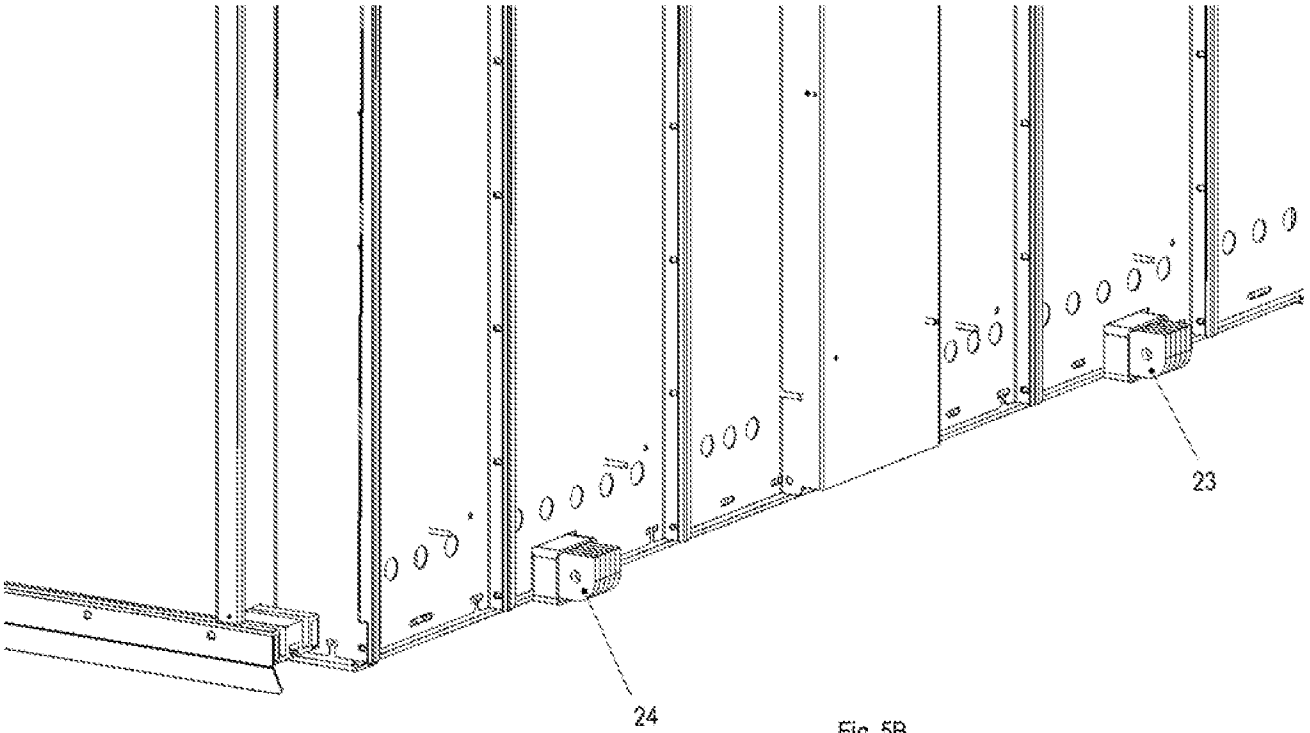
FIG. 5B shows a front side of the car of FIG. 2.

FIG. 5B shows a front side of the car. It will be apparent here that supports 23, 24 protrude slightly from channels 34, 35.

FIG. 6 shows a side view of the coupling between support 23, upright 21 and bottom part 33 as according to the embodiment of FIG. 3A. Visible in this figure are bolts 37 with which support 23 is attached to upright 21. A strengthening plate 38 is used here. Further shown are guides 39, 40 which guide the elevator car in the elevator shaft. The manner in which the elevator car is guided in the elevator shaft is realized here in known manner.

Ceiling part 41 of the elevator car, see FIG. 2, can likewise be provided with channels in similar manner to bottom part 33. This makes it possible to attach further supports 28, 29 of frame 20 to ceiling part 41 in simple manner.

The invention is described in the foregoing inter alia on the basis of embodiments thereof. It will be apparent to the skilled person that various changes to these embodiments are possible without departing from the scope of protection of the present invention as defined by the appended claims.

The invention claimed is:

1. A frame for a car of a passenger/freight elevator, comprising a pair of uprights disposed parallel to each other and extending in a transport direction of the passenger/freight elevator, wherein each upright is coupled to a support, wherein each support comprises a first part and a second part integrally connected to the first part, which parts lie at an angle relative to each other, wherein the first part runs parallel to the upright and is coupled to the upright in a direction transversely of the transport direction and wherein the second parts of the supports extend in a plane for of supporting a bottom part of the passenger/freight elevator;

wherein each support comprises a plurality of substantially identical strips, wherein the plurality of strips are placed adjacently of each other in a direction transversely of the transport direction for forming the support.

2. The frame as claimed in claim 1, wherein the frame is provided at an end remote from a bottom part with a first transverse connection between the pair of uprights and/or wherein the frame is provided at an end directed toward the bottom part with a second transverse connection between the pair of uprights.

3. A frame for a car of a passenger/freight elevator, comprising a pair of uprights disposed parallel to each other and extending in a transport direction of the passenger/freight elevator, wherein each upright is coupled to a support, wherein each support comprises a first part and a second part integrally connected to the first part, which parts lie at an angle relative to each other, wherein the first part runs parallel to the upright and is coupled to the upright in a direction transversely of the transport direction and wherein the second parts of the supports extend in a plane for supporting a bottom part of the passenger/freight elevator;

wherein each upright is coupled to a further support, wherein the further support comprises a third part and a fourth part integrally connected thereto, which third and fourth parts lie at an angle relative to each other, wherein the third part runs parallel to the upright and is coupled to the upright in a direction transversely of the transport direction, and wherein the fourth part of the further support extends in a plane for the purpose of supporting a ceiling part of the passenger/freight elevator; and wherein the further support comprises a further transition part between, and integrally connected to, the third and fourth parts, and wherein each upright is provided at an end directed toward a ceiling part with a further recess through which the further transition part of an associated further support protrudes.

4. A car of a passenger/freight elevator, comprising a frame comprising a pair of uprights disposed parallel to each other and extending in a transport direction of the passenger/freight elevator, wherein each upright is coupled to a support, wherein each support comprises a first part and a second part integrally connected to the first part, which parts lie at an angle relative to each other, wherein the first part runs parallel to the upright and is coupled to the upright in a direction transversely of the transport direction and wherein the second parts of the supports extend in a plane for supporting a bottom part of the passenger/freight elevator; and wherein each support comprises a plurality of substantially identical strips, wherein a part of each of the strips which corresponds to the second part of the support and a bottom part comprise corresponding openings through which a coupling means is placed for coupling the strips to each other and to the bottom part.

5. The car as claimed in claim 4, further comprising a ceiling part provided with an opening in which the fourth part of the further support is at least partially received.

6. The car as claimed in claim 5, wherein the opening in the ceiling part is formed as a channel connecting to the fourth part of the further support.

7. The car as claimed in claim 5, wherein the fourth part of the further support and the ceiling part comprise corresponding coupling openings through which a coupling means is placed for coupling the further support to the ceiling part.

* * * * *